US012692709B2

(12) United States Patent
Oerlemans

(10) Patent No.: US 12,692,709 B2
(45) Date of Patent: Jul. 28, 2026

(54) PANEL

(71) Applicant: BART OERLEMANS BV, Heeswijk Dinther (NL)

(72) Inventor: Bart Oerlemans, Heeswijk Dinther (NL)

(73) Assignee: BART OERLEMANS BV, Heeswijk Dinther (NL)

( * ) Notice: Subject to any disclaimer, the term of this patent is extended or adjusted under 35 U.S.C. 154(b) by 253 days.

(21) Appl. No.: 18/558,472

(22) PCT Filed: May 2, 2022

(86) PCT No.: PCT/IB2022/054026
§ 371 (c)(1),
(2) Date: Nov. 1, 2023

(87) PCT Pub. No.: WO2022/234424
PCT Pub. Date: Nov. 10, 2022

(65) Prior Publication Data

US 2024/0240467 A1 Jul. 18, 2024

(30) Foreign Application Priority Data

May 5, 2021 (EP) ..... 21172269

(51) Int. Cl.
*E04F 15/02* (2006.01)

(52) U.S. Cl.
CPC *E04F 15/02038* (2013.01); *E04F 2201/0107* (2013.01)

(58) Field of Classification Search
CPC . E04F 15/105; E04F 15/02038; E04F 15/107; E04F 15/102; E04F 2201/042;
(Continued)

(56) References Cited

U.S. PATENT DOCUMENTS 1,787,027 A 12/1930 Wasleff
6,247,285 B1 * 6/2001 Moebus ..... E04F 15/04 52/480

(Continued)

FOREIGN PATENT DOCUMENTS

DE 202019101603 U1 4/2019
DE 202020102526 U1 8/2021

(Continued)

OTHER PUBLICATIONS

International Search Report from corresponding PCT Application No. PCT/IB2022/054026, Jul. 18, 2022.

(Continued)

*Primary Examiner* — Chi Q Nguyen
(74) *Attorney, Agent, or Firm* — Workman Nydegger

(57) ABSTRACT

A rectangular panel comprises at each of its four edges a profile selected from a first profile, a second profile, and a third profile. The tongues and grooves of the three profiles are configured such that the panel edge or edges provided with the first profile can be coupled onto the panel edge or panel edges provided with the second profile of another such panel as well as onto the panel edge or panel edges provided with the third profile of another such panel; and such that the panel edge or edges provided with the second profile can be coupled onto the panel edge or panel edges provided with the third profile of another such panel. In each of these coupled configurations, a locking is provided of the coupled edges in the direction perpendicular to the surface of the coupled panels.

20 Claims, 4 Drawing Sheets

(58) Field of Classification Search
CPC ..... E04F 2201/0123; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 2201/0107
See application file for complete search history.

(56) References Cited

U.S. PATENT DOCUMENTS 6,521,314 B2 * 2/2003 Tychsen ..... E04F 15/02 428/57
6,823,638 B2 * 11/2004 Stanchfield ..... E04F 15/02 52/592.1
8,806,830 B2 * 8/2014 Schacht ..... E04F 15/043 52/390
9,896,851 B1 * 2/2018 Collins ..... B32B 9/042
11,993,939 B2 * 5/2024 Van Vlassenrode .... B32B 27/22
2003/0154681 A1 * 8/2003 Pletzer ..... E04F 15/04 52/592.1
2006/0024465 A1 * 2/2006 Briere ..... B32B 27/18 156/60
2008/0226865 A1 * 9/2008 Ljosland ..... B44C 3/005 156/247

FOREIGN PATENT DOCUMENTS

EP 1730366 B1 7/2008
EP 3128102 A1 2/2017

OTHER PUBLICATIONS

Extended European Search Report from corresponding EP Application No. 21172269.9, Nov. 9, 2011.

* cited by examiner

PANEL

BACKGROUND

The invention relates to panels, and particularly to decorative panels. The invention relates more specifically to floor panels and wall panels.

Rectangular decorative panels are known that have tongue and groove coupling parts at their pairs of opposite edges. These panels can be installed in rows.

For complex installation patterns, such as e.g. herringbone installation patterns, two types of panels are required. An example of sets of panels that can be installed in herringbone configuration is disclosed in U.S. Pat. No. 1,787,027.

SUMMARY

EP3128102A1 discloses panels with tongue and groove coupling means such that only one type of panels is required to install a herringbone pattern. The panels of EP3128102A1 have the disadvantage that special equipment is required for their manufacturing, and that their manufacturing requires a complex operation.

It is an objective of the invention to provide panels with tongue and groove coupling means such that a variety of complex installation patterns—such as herringbone patterns—are possible using only one type of panels.

It is an objective of the invention to provide such panels that can be easily manufactured with a minimum of manufacturing operations, and that do not require complex manufacturing equipment.

The first aspect of the invention is a panel. The panel is rectangular, oblong or square. The panel comprises a first pair of opposing edges, wherein the first pair of opposing edges comprises a first edge and a third edge. The panel comprises a second pair of opposing edges, wherein the second pair of opposing edges comprises a second edge and a fourth edge. Each of the first edge, the second edge, the third edge and the fourth edge comprises a profile selected from a first profile, a second profile and a third profile.

The first profile comprises a first tongue, a first groove and a second groove; wherein the first tongue is provided in the direction perpendicular to the panel surface between the first groove and the second groove, wherein the first groove is provided closer to the panel surface than the second groove, and wherein the second groove comprises a bottom lip. Preferably, the first tongue extends perpendicularly to the edge comprising the first profile.

The second profile comprises two tongues and a groove, wherein the groove is provided in the direction perpendicular to the panel surface between the two tongues. Preferably, each of the two tongues and the groove extend perpendicularly to the edge comprising second profile.

The third profile comprises a groove. Preferably, the groove extends perpendicularly to the edge comprising the third profile.

Each of the first profile, the second profile and the third profile extend continuously and along the full length of the edge(s) where they are provided. Two opposite edges of the first pair of opposite edges or the second pair of opposite edges are each provided with a first profile, or with a second profile or with a third profile.

The tongues and grooves of the first profile, the second profile and the third profile are configured such that the panel edge or edges provided with the first profile can be coupled onto the panel edge or panel edges provided with the second profile of another such panel as well as onto the panel edge or panel edges provided with the third profile of another such panel; and such that the panel edge or edges provided with the second profile can be coupled onto the panel edge or panel edges provided with the third profile of another such panel, wherein in each of these coupled configurations a locking is provided of the coupled edges in the direction perpendicular to the surface of the coupled panels.

It is a benefit that each of the first profile, the second profile and the third profile can be provided by one profiling only. Therefore, the manufacturing of the panels is facilitated as a minimum amount of tooling is required and no complex machinery is required for milling the panel edges. Using continuous profiles along the full length of the panel edges—with a constant cross section of the profiles—facilitates manufacturing as the milling machines do not need special control mechanisms to vary the profile along the length of the panel edge.

The panels provide a large variety of installation patterns that can be made with the panels. E.g. herringbone patterns, double herringbone patterns and block patterns can all be made with the same panels without adaptations being required.

The presence of the bottom lip at the second groove allows that coupled panel edges wherein one of the coupled panel edges comprises the first profile join each other closely at the bottom of the panel with no or minimal gap between the panel edges at the bottom of the coupled panels.

In a preferred embodiment of the invention, the first profile and the second profile are configured such that the first tongue of the first profile of the panel can be inserted in the groove of the second profile of another such panel, and such that each of the two tongues of the second profile of the another such panel can be inserted in a groove of the first groove and the second groove of the first profile of the panel, such that a locking is obtained in the direction perpendicular to the panel surface of the so coupled panel edges; wherein the first profile and the third profile are configured such that the first tongue of the panel can be inserted in the groove of the third profile of another such panel, such that a locking is obtained in the direction perpendicular to the panel surface of the so coupled panel edges; and wherein the second profile and the third profile are configured such that each of the two tongues of the second profile of the panel can be inserted in the groove of the third profile of another such panel, such that a locking is obtained in the direction perpendicular to the panel surface of the so coupled panel edges.

Such embodiments provide a very effective locking in the direction perpendicular to the coupled panel edges.

Preferably, the first tongue is tapered towards its distal end, optionally the taper can be linear or curved or a combination of curved and linear.

Preferably at least one, and more preferably both of the two tongues of the second profile is/are tapered towards its/their distal end(s).

Tapered tongues (and corresponding tapered grooves) can easily be manufactured and facilitate the insertion and locking of the tongues in the grooves when installing the panels in a covering.

The first profile, the second profile and the third profile preferably have a constant cross section along the full length of the panel edge(s) where they are provided. Such embodiments facilitate the manufacturing process of the panel edges, as no complex tooling is required in the manufacturing operation.

In a preferred embodiment of the invention, the groove of the third profile is a segmented groove, wherein the segmented groove comprises an upper groove section closest to the surface of the panel, a middle groove section and a bottom groove section, wherein the middle groove section extends more proximal into the panel than the upper groove section and the bottom groove section; wherein the middle groove section is provided for receiving the first tongue of the first profile of another such panel; wherein the upper groove section and the bottom groove section are provided each for receiving a tongue of the two tongues of the second profile of another such panel.

Such panels provide excellent locking in the direction perpendicular to the panel surface when a panel edge comprising the third profile is coupled to a panel edge comprising the first profile or the second profile.

More preferably, the middle groove section comprises an upper lip and a bottom lip, wherein the upper groove section comprises an upper lip, wherein the upper groove section extends at its bottom over part of its length as seen parallel with the panel surface into the middle groove section, wherein the bottom groove section comprises a bottom lip and extends at its upper side over part of its length as seen parallel with the panel surface into the middle groove section.

Such embodiment provide excellent locking in the direction perpendicular to the panel surface when a panel edge comprising the third profile is coupled to a panel edge comprising the first profile or the second profile.

In a preferred embodiment of the invention, each of the first edge, the second edge, the third edge and the fourth edge are provided closer to the panel surface than the first profile, the second profile and the third profile with a closing plane, wherein the closing planes are provided substantially perpendicular to the panel surface, and wherein in coupled condition of two panels the closing planes of the panel edges coupled to each other contact each other or are positioned closely to each other.

It is the intention that closing planes of coupled panels contact each other. However, due to manufacturing tolerance it cannot be excluded that a small gap occurs between the closing planes of coupled panels.

Preferably, the upper groove section and the bottom groove section have the same height and/or extend the same distance—as measured from the closing plane of the panel—into the panel edge.

It is a benefit of such embodiments that the tongues of the second profile can be made with the same height, this means that none of them is weaker than the other one. Therefore, the risk is minimized that the second profile is damaged during transport, storage or installation of the panels.

Preferably, none of the first profile, the second profile and the third profile are provided with mechanical locking means that would prevent that two such panels coupled at their edges could shift away from each other in the direction perpendicular to the coupled panel edges.

Such panels have less complex coupling profiles and are therefore more easy to manufacture as less complex milling equipment is required. Furthermore, there is less risk of breakage of the profiles or of part of it during manufacturing, transport or installation as the first profile, the second profile and the third profile can be made sufficiently sturdy.

The first tongue preferably has a convex cross section in the direction perpendicular to the panel edge where the first profile is provided. This makes the first profile easy to produce, and minimizes the risk of breakage or damage of the first tongue in manufacturing, transport and installation.

A preferred panel is rectangular and oblong, wherein both short panel edges are provided with the first profile or with the second profile or with the third profile, wherein both short edges are configured such that they can be coupled at any position along the length of any one of both long edges.

Such panels allow installation in herringbone configuration, as well as in a number of other complex configurations.

Preferably, the lower lip of the first groove is provided by the first tongue; and the upper lip of the second groove is provided by the first tongue.

Such panels are easy to produce, as the first profile has a more simple configuration.

Preferably, the first groove extends into the panel to the same depth parallel with the panel surface as the second groove.

It means that both tongues of the second profile can be made to have the same length, which makes them less vulnerable in transport and installation.

Preferably, the first groove and the second groove have the same height.

It means that both tongues of the second profile can have the same thickness, such that there is no smaller one which would be more vulnerable in production, transport and installation.

In a preferred embodiment, the two tongues of the second profile extend perpendicularly to the panel edge to the same plane perpendicular to the panel surface and parallel with the panel edge.

It is a benefit of this embodiment that the second profile is less vulnerable in production, transport and installation.

In a preferred embodiment, the panel edge(s) comprising the second profile is/are provided with an undercut, wherein the undercut is provided closer to the panel surface than the tongue of the tongues of the second profile closest to the panel surface. More preferably, the undercut is provided adjacent to the tongue of the tongues of the second profile closest to the panel surface.

The undercut has the benefit that glue used to glue panel edges together—wherein one of the panel edges comprises the second profile—can be collected in the undercut when excessive amount of glue would have been used.

In a preferred embodiment, the panel comprises a decorative wood layer and one or a plurality of supporting layers.

Preferably, the tongues and grooves of the first profile, the second profile and the third profile are provided integrally in the one or plurality of supporting layers and do not extend into the decorative wood layer. Such embodiments allow to make optimum choices for the layers of the panel, e.g. to optimize the strength of the panel coupling.

The supporting layers are preferably one or a plurality of wood layers and/or wood based layers such as oriented strand board, plywood, fiber board or particle board.

The second aspect of the invention is a set of panels comprising and preferably consisting of panels as in any embodiment of the first aspect of the invention.

The third aspect of the invention is a floor- or wall covering comprising a set of panels as in the second aspect of the invention or comprising a plurality of panels as in any embodiment of the first aspect of the invention, wherein the panels are installed in a configuration wherein at least some of the panels make a 90° angle relative to each other; e.g. wherein the panels are installed in a herringbone configuration or in a double herringbone configuration.

BRIEF DESCRIPTION OF THE DRAWINGS

With the intention of better showing the characteristics of the invention, hereafter, as an example without any limitative character, preferred embodiments are described, with reference to the accompanying drawings, wherein.

DETAILED DESCRIPTION OF VARIOUS EMBODIMENTS

Figure 1:
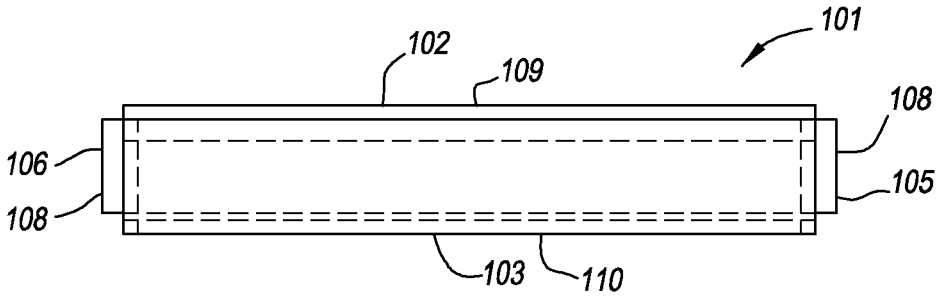
FIG. 1 shows a panel according to the invention.

FIG. 1 shows a panel 101 according to the invention. The panel 101 is rectangular and oblong. The panel comprises a first pair of opposing edges 102, 103, wherein the first pair of opposing edges comprises a first edge 102 and a third edge 103, in the example shown provided at the long edges of the panel. The panel comprises a second pair of opposing edges 105, 106, wherein the second pair of opposing edges comprises a second edge 105 and a fourth edge 106, provided at the short edges of the panel.

Figure 2:
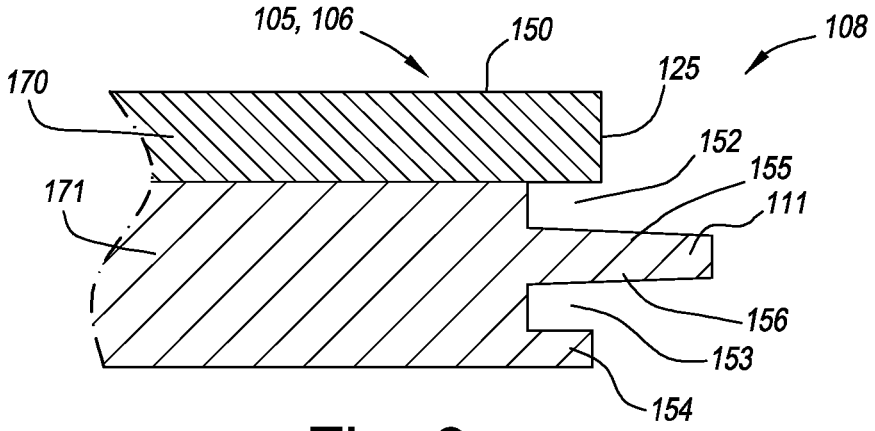
FIG. 2 shows a panel edge comprising the first profile.
Figure 3:
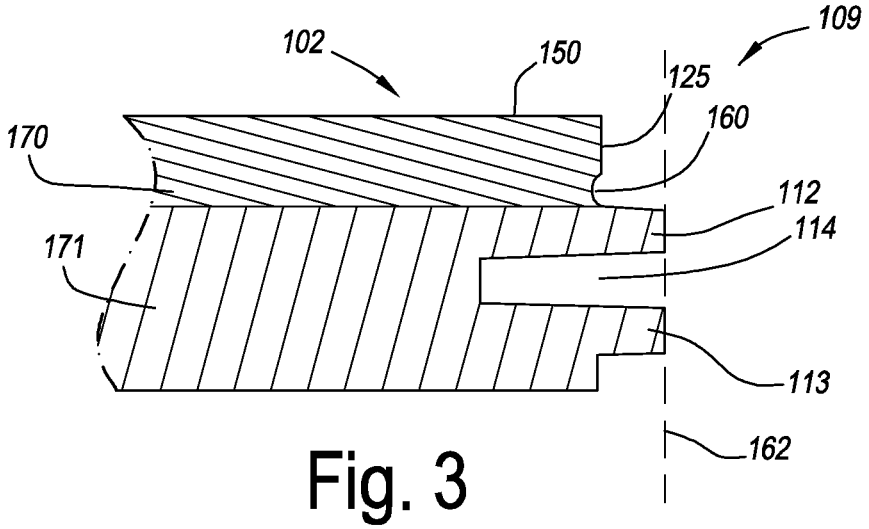
FIG. 3 shows a panel edge comprising the second profile.
Figure 4:
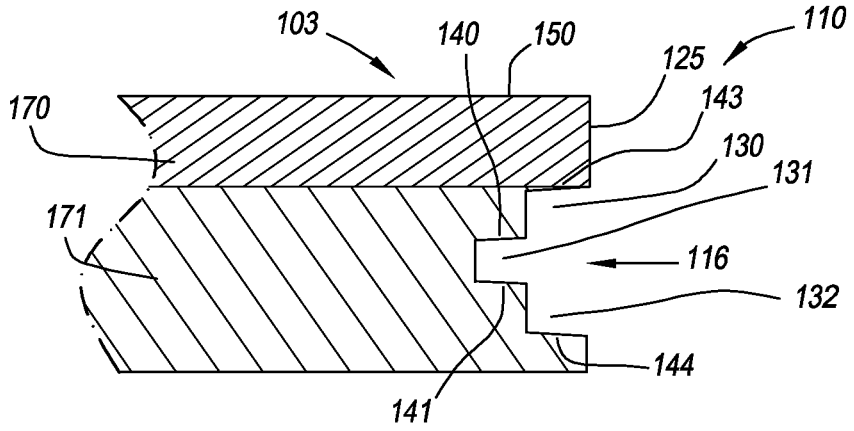
FIG. 4 shows a panel edge comprising the third profile.

In the example shown in FIG. 1, the second edge 105 and the fourth edge 106 are provided with a first profile 108. The first edge 102 is provided with a second profile 109, and the third edge 103 is provided with a third profile 110. Each of the first profile 108, the second profile 109 and the third profile 110 extend continuously and along the full length of the edge(s) where they are provided. Each of the first profile 108, the second profile 109 and the third profile 110 have a constant cross section along the full length of the panel edge(s) where they are provided. FIGS. 2-4 explain the details of the first profile 108, the second profile 109 and the third profile 110 as used in the panel 101 of FIG. 1.

FIG. 2 shows a panel edge 105, 106 comprising the first profile 108. The first profile 108 comprises a first tongue 111, a first groove 152 and a second groove 153. The first tongue 111 is provided in the direction perpendicular to the panel surface 150 between the first groove 152 and the second groove 153. The first groove 152 is provided closer to the panel surface 150 than the second groove 153. The second groove 153 comprises a bottom lip 154. The first tongue 111 extends perpendicularly to the edge comprising the first profile 108.

The lower lip 155 of the first groove 152 is provided by the first tongue 111. The upper lip 156 of the second groove 153 is provided by the first tongue 111. The first groove 152 extends parallel with the panel surface into the panel to the same depth as the second groove 153.

The first groove 152 and the second groove 153 have the same height.

In the example shown, the first tongue 111 is tapered towards its distal end. The first tongue 111 has a convex cross section in the direction perpendicular to the panel edge where the first profile is provided.

FIG. 3 shows a panel edge 102 comprising the second profile 109. The second profile 109 comprises two tongues 112, 113 and a groove 114. The groove 114 is provided in the direction perpendicular to the panel surface 150 between the two tongues 112, 113. Each of the two tongues 112, 113 and the groove 114 extend perpendicularly to the edge comprising the second profile 109. In the example shown, the two tongues 112, 113 of the second profile 109 are tapered towards their distal ends.

The two tongues 112, 113 extend perpendicularly to the panel edge to the same plane 162 perpendicular to the panel surface 250 and parallel with the panel edge 102.

The panel edge 102 comprising the second profile 109 is provided with an undercut 160. The undercut 160 is provided closer to the panel surface 150 than the tongue 112 of the two tongues 112, 113 closest to the panel surface 150. The undercut 160 is provided adjacent to the tongue 112 closest to the panel surface 150. Such undercut has the benefit that glue used to glue panel edges together can be collected in the undercut especially when excessive amount of glue would have been used.

FIG. 4 shows a panel edge 103 comprising the third profile 110. The third profile 110 comprises a groove 116. The groove 116 extends perpendicularly to the edge comprising the third profile 110. The groove 116 of the third profile 110 is a segmented groove, comprising an upper groove section 130 closest to the surface 250 of the panel, a middle groove section 131 and a bottom groove section 132. The middle groove section 131 extends more proximal into the panel than the upper groove section 130 and the bottom groove section 132. The middle groove section 131 is provided for receiving the first tongue 111 of the first profile 108 of another such panel. The upper groove section 130 and the bottom groove section 132 are provided each for receiving a tongue 112, 113 of the second profile 109 of another such panel.

The middle groove section 131 comprises an upper lip 140 and a bottom lip 141. The upper groove section 130 comprises an upper lip 143. The upper groove section 130 extends at its bottom into 131 over part of its length parallel with the panel surface into the middle groove section. The bottom groove section 132 comprises a bottom lip 144 and extends at its upper side over part of its length as seen parallel with the panel surface into the middle groove section 131.

In the example shown, the upper groove section 130 and the bottom groove section 132 have the same height and extend the same distance into the panel edge where they are provided.

The panel 101 of the example shown comprises a decorative wood layer 170 and one or a plurality of supporting layers 171, in the example shown wood supporting layers. The tongues 111, 112, 113 and grooves 152, 153, 114, 116 of the first profile 108, the second profile 109 and the third profile 110 are provided integrally in the one or plurality of supporting layers 171 and do not extend into the decorative wood layer 170.

In the examples shown, each of the first edge 102, the second edge 105, the third edge 103 and the fourth edge 106 are provided closer to the panel surface 150 than the first profile 108, the second profile 109 and the third profile 110 with a closing plane 125. The closing planes 125 are provided substantially perpendicular to the panel surface 150. In coupled condition of two panels the closing planes of the panel edges coupled to each other contact each other or are positioned closely to each other.

In the examples shown, none of the first profile 108, the second profile 109 and the third profile 110 are provided with mechanical locking means that would prevent that two such panels coupled at their edges could shift away from each other in the direction perpendicular to the coupled panel edges.

Each of the examples shown of the first profile 108, the second profile 109 and the third profile 110 can be provided by one profiling. No complex milling equipment nor complicated manufacturing process is required.

Figure 5:
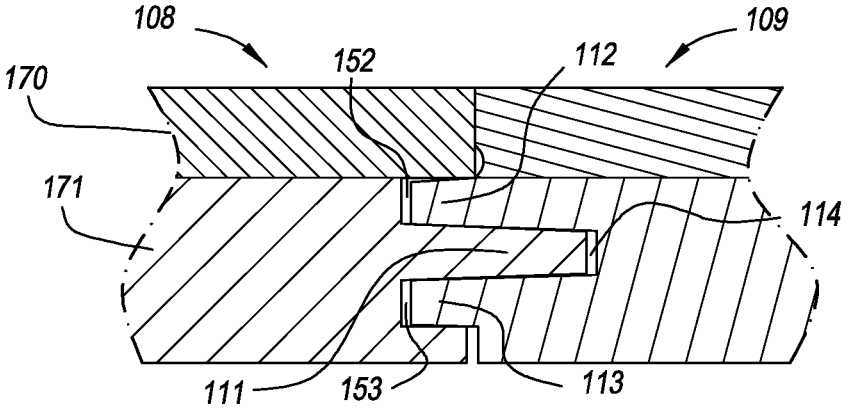
FIG. 5 shows a panel edge comprising the first profile coupled to a panel edge comprising the second profile.
Figure 6:
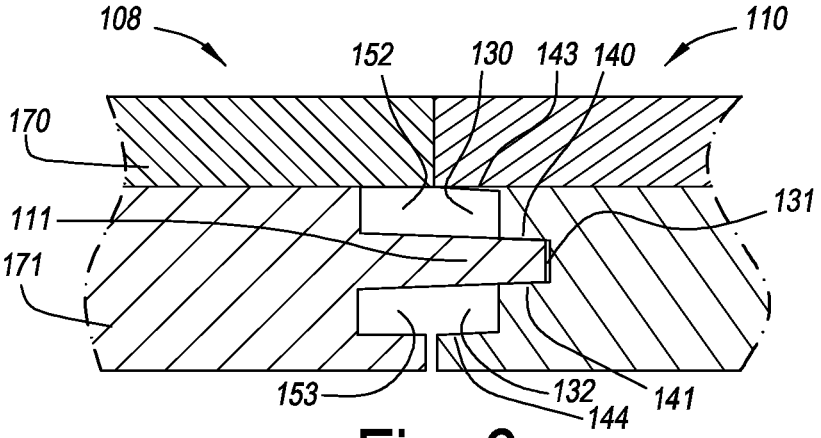
FIG. 6 shows a panel edge comprising the first profile coupled to a panel edge comprising the third profile.
Figure 7:
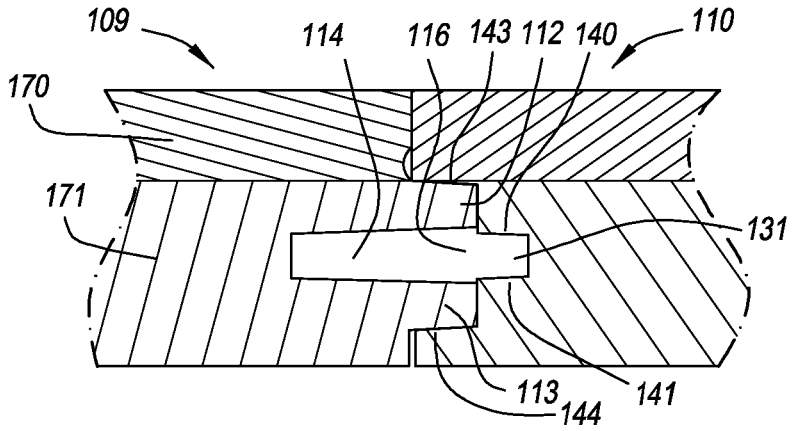
FIG. 7 shows a panel edge comprising the second profile coupled to a panel edge comprising the third profile.

FIGS. 5-7 show the panel edges and profiles shown in FIGS. 2-4 coupled to each other. FIG. 5 shows a panel edge comprising the first profile 108 coupled to a panel edge comprising the second profile 109. FIG. 6 shows a panel edge comprising the first profile 108 coupled to a panel edge comprising the third profile 110. FIG. 7 shows a panel edge comprising the second profile 109 coupled to a panel edge comprising the third profile 110. The tongues 111, 112, 113 and grooves 152, 153, 114, 116 of the first profile 108, the second profile 109 and the third profile 110 are configured such that the panel edge or edges provided with the first profile 108 can be coupled onto the panel edge or panel edges provided with the second profile 109 of another such panel as well as onto the panel edge or panel edges provided with the third profile 110 of another such panel, and such that the panel edge or edges provided with the second profile 109 can be coupled onto the panel edge or panel edges provided with the third profile 110 of another such panel. In each of these coupled configurations a locking is provided of the coupled edges in the direction perpendicular to the surface of the coupled panels.

As becomes clear from FIG. 5, the first profile 108 and the second profile 109 are configured such that the first tongue 111 of the first profile 108 can be inserted in the groove 114 of the second profile 109 of another such panel, and such that each of the two tongues 112, 113 of the second profile 109 of the another such panel can be inserted in a groove 152, 153 of the first groove 152 and the second groove 153 of the first profile 108 of the panel, such that a locking is obtained in the direction perpendicular to the panel surface of the so coupled panel edges.

As becomes clear from FIG. 6, the first profile 108 and the third profile 110 are configured such that the first tongue 111 of the panel can be inserted in the groove 116 of the third profile 110 of another such panel, such that a locking is obtained in the direction perpendicular to the panel surface of the so coupled panel edges.

As becomes clear from FIG. 7, the second profile 109 and the third profile 110 are configured such that each of the two tongues 112, 113 of the second profile 109 of the panel can be inserted in the groove 116 of the third profile of another such panel, such that a locking is obtained in the direction perpendicular to the panel surface of the so coupled panel edges.

The panel according to the invention as illustrated in FIGS. 1-7 can be installed in a plurality of installation patterns. This is possible as both short edges 105, 106 of the panel can be coupled at any position along the length of each of the two long panel edges 102, 103.

Figure 8:
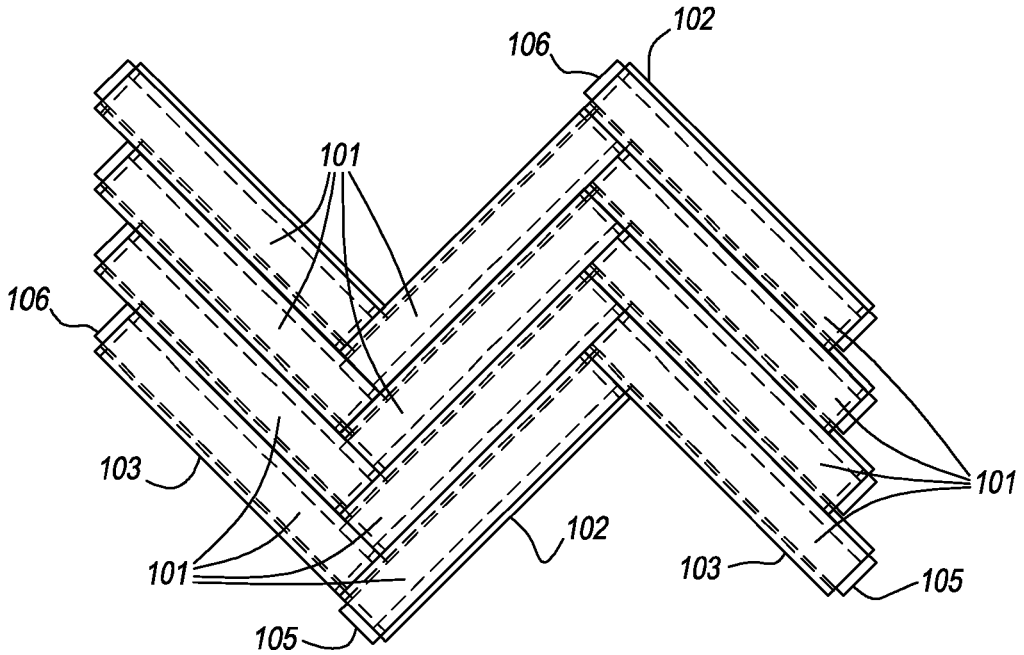
FIG. 8 illustrates a herringbone pattern obtained with the panels of FIG. 1.
Figure 9:
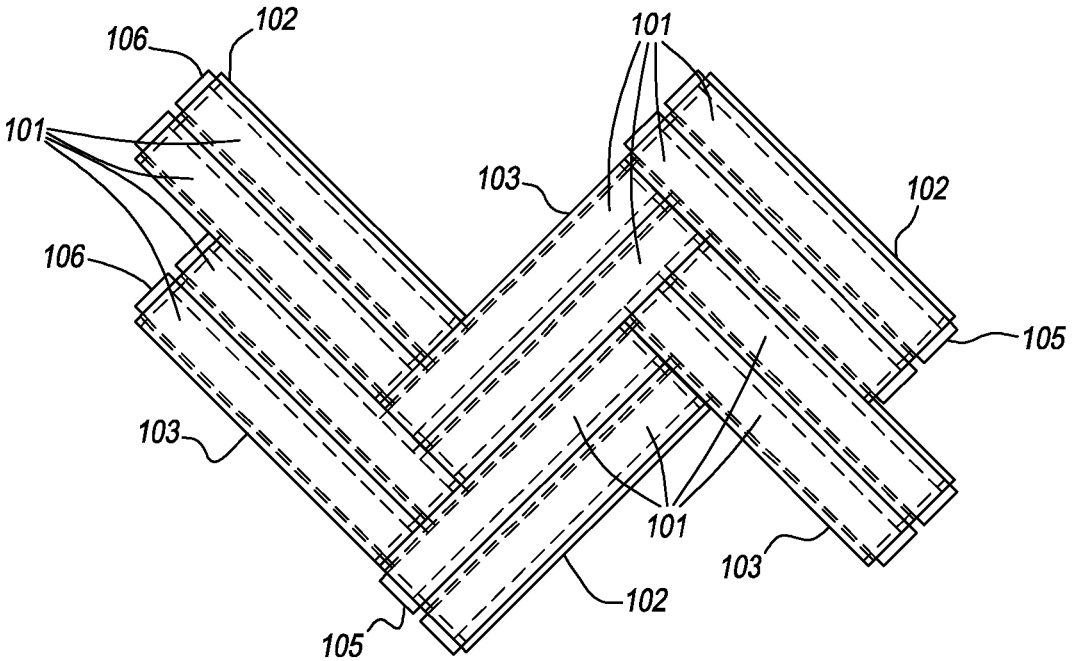
FIG. 9 illustrates a double herringbone pattern obtained with the panels of FIG. 1.
Figure 10:
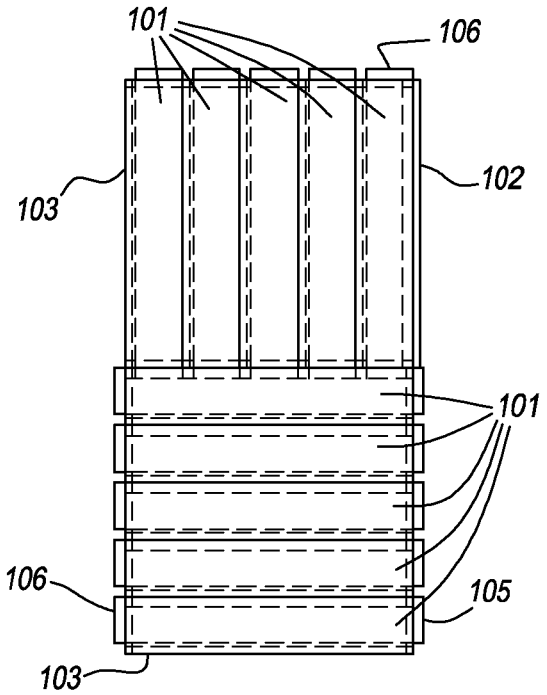
FIG. 10 illustrates a block pattern obtained with the panels of FIG. 1.

FIGS. 8, 9 and 10 show examples of installation patterns that are possible with the panel of the invention illustrated in FIGS. 1-7. FIG. 8 shows a herringbone pattern obtained with the panels 101 of FIG. 1. FIG. 9 shows a double herringbone pattern obtained with the panels 101 of FIG. 1. FIG. 10 shows a block pattern obtained with the panels 101 of FIG. 1.

The present invention is in no way limited to the embodiments described as an example and represented in the figures, on the contrary may such panel be realized in various forms and dimensions, without leaving the scope of the invention.

The invention further relates the following number list of items:

Item 1.—Panel (101), wherein the panel is rectangular, oblong or square, wherein the panel comprises a first pair of opposing edges (102, 103), wherein the first pair of opposing edges comprises a first edge (102) and a third edge (103), wherein the panel comprises a second pair of opposing edges (105, 106), wherein the second pair of opposing edges comprises a second edge (105) and a fourth edge (106), wherein each of the first edge, the second edge, the third edge and the fourth edge comprises a profile selected from a first profile (108), a second profile (109) and a third profile (110), wherein the first profile (108) comprises a first tongue (111), a first groove (152) and a second groove (153), wherein the first tongue is provided in the direction perpendicular to the panel surface (150) between the first groove and the second groove, wherein the first groove is provided closer to the panel surface (150) than the second groove, wherein the second groove comprises a bottom lip (154), preferably wherein the first tongue (111) extends perpendicularly to the edge comprising the first profile (108), wherein the second profile (109) comprises two tongues (112, 113) and a groove (114), wherein the groove (114) is provided in the direction perpendicular to the panel surface (150) between the two tongues (112, 113), preferably wherein each of the two tongues (112, 113) and the groove (114) extend perpendicularly to the edge comprising second profile (109), wherein the third profile (110) comprises a groove (116), preferably wherein the groove extends perpendicularly to the edge comprising the third profile (110), wherein each of the first profile, the second profile and the third profile extend continuously and along the full length of the edge(s) where they are provided;

wherein two opposite edges of the first pair of opposite edges or the second pair of opposite edges are each provided with a first profile, or with a second profile or with a third profile;

wherein the tongues (111, 112, 113) and grooves (152, 153, 114, 116) of the first profile (108), the second profile (109) and the third profile (110) are configured such that the panel edge or edges provided with the first profile (108) can be coupled onto the panel edge or panel edges provided with the second profile (109) of another such panel as well as onto the panel edge or panel edges provided with the third profile (110) of another such panel, and such that the panel edge or edges provided with the second profile (109) can be coupled onto the panel edge or panel edges provided with the third profile (110) of another such panel, wherein in each of these coupled configurations a locking is provided of the coupled edges in the direction perpendicular to the surface of the coupled panels.

Item 2.—Panel as in item 1, wherein the first profile (108) and the second profile (109) are configured such that the first tongue (111) of the first profile of the panel can be inserted in the groove (114) of the second profile (109) of another such panel, and such that each of the two tongues (112, 113) of the second profile (109) of the another such panel can be inserted in a groove (152, 153) of the first groove (152) and the second groove (153) of the first profile (108) of the panel, such that a locking is obtained in the direction perpendicular to the panel surface of the so coupled panel edges; and wherein the first profile (108) and the third profile (110) are configured such that the first tongue (111) of the panel can be inserted in the groove (116) of the third profile (110) of another such panel, such that a locking is obtained in the direction perpendicular to the panel surface of the so coupled panel edges; and wherein the second profile (109) and the third profile (110) are configured such that each of the two tongues (112, 113) of the second profile (109) of the panel can be inserted in the groove (116) of the third profile of another such panel, such that a locking is obtained in the direction perpendicular to the panel surface of the so coupled panel edges.

Item 3.—Panel as in any of the preceding items, wherein the first tongue (111) is tapered towards its distal end, optionally the taper can be linear or curved or a combination of curved and linear.

Item 4.—Panel as in any of the preceding claims, wherein at least one and preferably both of the two tongues (112, 113) of the second profile (109) is/are tapered towards its/their distal end(s).

Item 5.—Panel as in any of the preceding items, wherein the first profile (108), the second profile (109) and the third profile (110) have a constant cross section along the full length of the panel edge(s) where they are provided.

Item 6.—Panel as in any of the preceding items, wherein the groove (116) of the third profile (110) is a segmented groove, wherein the segmented groove comprises an upper groove section (130) closest to the surface of the panel, a middle groove section (131) and a bottom groove section (132), wherein the middle groove section (131) extends more proximal into the panel than the upper groove section (130) and the bottom groove section (132);

wherein the middle groove section (131) is provided for receiving the first tongue (111) of the first profile (108) of another such panel;

wherein the upper groove section (130) and the bottom groove section (132) are provided each for receiving a tongue (112, 113) of the two tongues of the second profile (109) of another such panel.

Item 7.—Panel as in item 6, wherein the middle groove section (131) comprises an upper lip (140) and a bottom lip (141), wherein the upper groove section (130) comprises an upper lip (143), wherein the upper groove section (130) extends at its bottom over part of its length as seen parallel with the panel surface (150) into the middle groove section (131), wherein the bottom groove section (132) comprises a bottom lip (144) and extends at its upper side over part of its length as seen parallel with the panel surface (150) into the middle groove section (131).

Item 8.—Panel as in any of the preceding items, wherein each of the first edge (102), the second edge (105), the third edge (103) and the fourth edge (106) are provided closer to the panel surface (150) than the first profile (108), the second profile (109) and the third profile (110) with a closing plane (125), wherein the closing planes (125) are provided substantially perpendicular to the panel surface (150), and wherein in coupled condition of two panels the closing planes of the panel edges coupled to each other contact each other or are positioned closely to each other.

Item 9.—Panel as in items 6 or 7 and as in item 8, wherein the upper groove section (130) and the bottom groove section (132) have the same height and/or extend the same distance—as measured from the closing plane (225) of the panel—into the panel edge.

Item 10.—Panel as in any of the preceding items, wherein none of the first profile (108), the second profile (109) and the third profile (110) are provided with mechanical locking means that would prevent that two such panels coupled at their edges could shift away from each other in the direction perpendicular to the coupled panel edges.

Item 11.—Panel as in any of the preceding items, wherein the first tongue (111) has a convex cross section.

Item 12.—Panel as in any of the preceding items, wherein the panel is rectangular and oblong, wherein both short panel edges are provided with the first profile (108) or with the second profile (109) or with the third profile (110), wherein both short edges are configured such that they can be coupled at any position along the length of any one of both long edges.

Item 13.—Panel as in any of the preceding items, wherein the lower lip (155) of the first groove (152) is provided by the first tongue (111) and wherein the upper lip (156) of the second groove (153) is provided by the first tongue (111).

Item 14.—Panel as in any of the preceding items, wherein the first groove (152) extends into the panel to the same depth parallel with the panel surface as the second groove (153).

Item 15.—Panels as in any of the preceding items, wherein the first groove (152) and the second groove (153) have the same height.

Item 16.—Panel as in any of the preceding items, wherein the two tongues (112, 113) of the second profile extend perpendicularly to the panel edge to the same plane perpendicular to the panel surface and parallel with the panel edge.

Item 17.—Panel as in any of the preceding items, wherein the panel edge(s) comprising the second profile is/are provided with an undercut (160), wherein the undercut is provided closer to the panel surface (150) than the tongue of the tongues of the second profile closest to the panel surface, preferably wherein the undercut is provided adjacent to the tongue of the tongues of the second profile closest to the panel surface.

Item 18.—Panel as in any of the preceding items, wherein the panel comprises a decorative wood layer (170) and one or a plurality of supporting layers (171), preferably wherein the tongues (111, 112, 113) and grooves (152, 153, 114, 116) of the first profile (108), the second profile (109) and the third profile (110) are provided integrally in the one or plurality of supporting layers (171) and do not extend into the decorative wood layer (170).

Item 19.—Panel as in any of the preceding items, wherein the first tongue (111) of the first profile (108) extends perpendicularly to the edge comprising the first profile (108).

Item 20.—Panel as in any of the preceding items, wherein each of the two tongues (112, 113) and the groove (114) of the second profile (109) extend perpendicularly to the edge comprising second profile (109), Item 21.—Panel as in any of the preceding items, wherein the groove (116) of the third profile (110) extends perpendicularly to the edge comprising the third profile (110), Item 22.—Set of panels, wherein the set of panels comprises and preferably consists of panels (101) as in any of the preceding items.

Item 23.—Floor- or wall covering comprising a set of panels as in item 22 or comprising a plurality of panels as in any of the preceding items 1-21, wherein the panels are installed in a configuration wherein at least some of the panels make a 90° angle relative to each other; e.g. wherein the panels are installed in a herringbone configuration or in a double herringbone configuration.

The invention claimed is:

1. A panel, wherein the panel is rectangular, oblong or square, wherein the panel comprises a first pair of opposing edges, wherein the first pair of opposing edges comprises a first edge and a third edge, wherein the panel comprises a second pair of opposing edges, wherein the second pair of opposing edges comprises a second edge and a fourth edge, wherein each of the first edge, the second edge, the third edge and the fourth edge comprises a profile selected from a first profile, a second profile and a third profile, wherein the first profile comprises a first tongue, a first groove and a second groove, wherein the first tongue is provided in a direction perpendicular to a panel surface between the first groove and the second groove, wherein the first groove is provided closer to the panel surface than the second groove, wherein the second groove comprises a bottom lip, wherein the first tongue extends perpendicularly to one of the first second, third or fourth edges comprising the first profile, wherein the second profile comprises two tongues and a groove, wherein the groove is provided in a direction perpendicular to the panel surface between the two tongues, wherein each of the two tongues and the groove extend perpendicularly to one of the first, second, third, or fourth edges comprising second profile, wherein the third profile comprises a groove, wherein the groove extends perpendicularly to one of the first, second, third, or fourth edges comprising the third profile, wherein each of the first profile, the second profile and the third profile extend continuously and along a full length of the edge where said respective profile is provided;

wherein two opposite edges of the first pair of opposite edges or the second pair of opposite edges are each provided with a first profile, or with a second profile or with a third profile;

wherein the tongues and grooves of the first profile, the second profile and the third profile are configured in coupled configurations such that (i) the panel edge or edges provided with the first profile can be coupled onto the panel edge or panel edges provided with the second profile of another such panel;

(ii) the panel edge or edges provided with the first profile can be coupled onto the panel edge or panel edges provided with the third profile of another such panel; and (iii) the panel edge or edges provided with the second profile can be coupled onto the panel edge or panel edges provided with the third profile of another such panel;

wherein in each of the coupled configurations (i)-(iii), a locking is provided of the coupled edges in a direction perpendicular to the panel surface of the coupled panels.

2. The panel according to claim 1, wherein the first profile and the second profile are configured such that the first tongue of the first profile of the panel can be inserted in the groove of the second profile of another such panel, and such that each of the two tongues of the second profile of the another such panel can be inserted in a groove of the first groove and the second groove of the first profile of the panel, such that a locking is obtained in the direction perpendicular to the panel surface of the coupled panel edges; and wherein the first profile and the third profile are configured such that the first tongue of the panel can be inserted in the groove of the third profile of another such panel, such that a locking is obtained in the direction perpendicular to the panel surface of the coupled panel edges; and wherein the second profile and the third profile are configured such that each of the two tongues of the second profile of the panel can be inserted in the groove of the third profile of another such panel, such that a locking is obtained in the direction perpendicular to the panel surface of the so-coupled panel edges.

3. The panel according to claim 1, wherein the first tongue is tapered towards a distal end of the first tongue, and/or wherein at least one of the two tongues of the second profile is tapered towards a distal end of the respective tongue.

4. The panel according to claim 1, wherein the first profile, the second profile and the third profile have a constant cross section along the full length of a panel edge where said respective profile is provided.

5. The panel according to claim 1, wherein the groove of the third profile is a segmented groove, wherein the segmented groove comprises an upper groove section closest to the surface of the panel, a middle groove section and a bottom groove section, wherein the middle groove section extends more proximal into the panel than the upper groove section and the bottom groove section;

wherein the middle groove section is provided for receiving the first tongue of the first profile of another such panel;

wherein the upper groove section and the bottom groove section are provided each for receiving a tongue of the two tongues of the second profile of another such panel.

6. The panel according to claim 5, wherein the middle groove section comprises an upper lip and a bottom lip, wherein the upper groove section comprises an upper lip, wherein the upper groove section extends at its bottom over part of its length as seen parallel with the panel surface into the middle groove section, wherein the bottom groove section comprises a bottom lip and extends at its upper side over part of its length as seen parallel with the panel surface into the middle groove section.

7. The panel according to claim 5, wherein the upper groove section and the bottom groove section have the same height and/or extend the same distance, as measured from a closing plane of the panel into the panel edge.

8. The panel according to claim 1, wherein each of the first edge, the second edge, the third edge and the fourth edge are provided closer to the panel surface than the first profile, the second profile and the third profile with a closing plane, wherein the closing planes are provided substantially perpendicular to the panel surface, and wherein in coupled condition of two panels the closing planes of the panel edges coupled to each other contact each other or are positioned closely to each other.

9. The panel according to claim 1, wherein none of the first profile, the second profile and the third profile are provided with mechanical locking means that would prevent that two such panels coupled at their edges could shift away from each other in a direction perpendicular to the coupled panel edges.

10. The panel according to claim 1, wherein the first tongue has a convex cross section.

11. The panel according to claim 1, wherein the panel is rectangular and oblong, wherein both short panel edges are provided with the first profile or with the second profile or with the third profile, wherein both short edges are configured such that both said short edges can be coupled at any position along the length of any one of both long edges.

12. The panel according to claim 1, wherein the lower lip of the first groove is provided by the first tongue and wherein an upper lip of the second groove is provided by the first tongue.

13. The panel according to claim 1, wherein the first groove extends into the panel to the same depth parallel with the panel surface as the second groove.

14. The panel according to claim 1, wherein the first groove and the second groove have the same height.

15. The panel according to claim 1, wherein the two tongues of the second profile extend perpendicularly to the panel edge to the same plane perpendicular to the panel surface and parallel with the panel edge.

16. The panel according to claim 1, wherein the panel comprising the second profile is/are provided with an undercut, wherein the undercut is provided closer to the panel surface than the tongue of the tongues of the second profile closest to the panel surface, wherein the undercut is provided adjacent to the tongue of the tongues of the second profile closest to the panel surface.

17. The panel according to claim 1, wherein the panel comprises a decorative wood layer and one or a plurality of supporting layers, wherein the tongues and grooves of the first profile, the second profile and the third profile are provided integrally in the one or plurality of supporting layers and do not extend into the decorative wood layer.

18. The panel according to claim 1, wherein the first tongue of the first profile extends perpendicularly to one of the first, second, third or fourth edges comprising the first profile and/or wherein each of the two tongues and the groove of the second profile extend perpendicularly to the edge comprising second profile.

19. The panel according to claim 1, wherein the groove of the third profile extends perpendicularly to one of the first, second, third or fourth edges comprising the third profile.

20. A floor- or wall covering comprising a plurality of panels according to claim 1, wherein the panels are installed in a configuration wherein at least some of the panels make a 90° angle relative to each other;

wherein the panels are installed in a herringbone configuration or in a double herringbone configuration.

* * * * *